United States Patent [19]

Yoshiura et al.

[11] Patent Number: 4,597,663

[45] Date of Patent: Jul. 1, 1986

[54] ELECTROPHOTOGRAPHIC COPYING MACHINE OF AUTOMATIC MAGNIFICATION/REDUCTION-CONTROLLABLE TYPE

[75] Inventors: Shoichiro Yoshiura; Haruyoshi Ikeda, both of Yamatokoriyama, Japan

[73] Assignee: Sharp Kabushiki Kaisha, Osaka, Japan

[21] Appl. No.: 719,869

[22] Filed: Apr. 4, 1985

[30] Foreign Application Priority Data

Apr. 5, 1984 [JP] Japan ..... 59-69774

[51] Int. Cl.[4] ..... G03G 15/00

[52] U.S. Cl. ..... 355/14 R; 355/55

[58] Field of Search ..... 355/14 R, 14 SH, 3 SH, 355/55–57, 60, 61

[56] References Cited

U.S. PATENT DOCUMENTS 4,211,482 7/1980 Arai et al. ..... 355/57 X
4,260,248 4/1981 Murata et al. ..... 355/60
4,277,163 7/1981 Ikesue ..... 355/56 X
4,338,020 7/1982 Yukawa et al. ..... 355/61 X
4,351,606 9/1982 Franko ..... 355/55 X

*Primary Examiner*—R. L. Moses
*Attorney, Agent, or Firm*—Birch, Stewart, Kolasch & Birch

[57] ABSTRACT

An electrophotographic copying machine of an automatic magnification/reduction-controllable type comprises a measurement circuit, a comparison circuit, and a display. The measurement circuit is provided for measuring the lengths of a copy document along its horizontal side and a vertical side. The comparison circuit compares the length of the horizontal side with that of the vertical side. The display displays either a first type of copy paper suitable for longitudinal feed when the length of the horizontal side is longer than that of the vertical side or a second type of copy paper when the length of the horizontal side is shorter than that of the vertical side.

4 Claims, 11 Drawing Figures

ELECTROPHOTOGRAPHIC COPYING MACHINE OF AUTOMATIC MAGNIFICATION/REDUCTION-CONTROLLABLE TYPE

BACKGROUND OF THE INVENTION

The present invention relates to an electrophotographic copying machine and, more particularly, to an electrophotographic copying machine of an automatic magnification/reduction-controllable type for displaying a suitable type of copy paper to be used.

Conventional electrophotographic copying machines of a magnification/reduction-controllable type are such that the operator must manually select a magnification scale with keys and, then, select the type of a copy paper to be copied. In other words, to do the magnification/reduction-copy, the operator must know the information of the size of a document to be copied, the size of magnifying or reducing the document, and the size of a copy paper on which the magnified or reduced copy image can be prepared.

Thus, the operator should know the relation between the document size, the magnification/reduction scale, and the copy paper size. Because their relation is relied upon the detection of the operator, the correct magnification/reduction copy cannot always be expected. Since the copy paper can be fed within the body of the copying machine along either the width direction of the paper or the longitudinal direction of the paper for copying, the operator must judge such a difference. Otherwise, a part or half of the image may missing being copied.

SUMMARY OF THE INVENTION

Accordingly, it is an object of the present invention to provide an improved electrophotographic copying machine with an automatic magnification/reduction-controllable function for displaying a suitable type of copy paper to be used.

It is another object of the present invention to provide an improved electrophotographic copying machine of an automatic magnification/reduction-controllable type for measuring the width and the length of a copy document and displaying a suitable type of copy paper depending on the detection.

It is a further object of the present invention to provide an improved electrophotographic copying machine with an automatic magnification/reduction-controllable type for measuring the width and the length of a copy document and displaying a type of either longitudinal feed copy paper for a copy document in width or cross feed copy paper for a copy document in depth.

Briefly described, in accordance with the present invention, an electrophotographic copying machine with an automatic magnification/reduction-controllable function comprises measurement means for measuring the lengths of a horizontal side and a vertical side of a copy document, comparison means for comparing the length of the horizontal side with that of the vertical side, and display means for displaying either a first type of copy paper suitable for longitudinal feed when the length of the horizontal side is longer than that of the vertical side or a second type of copy paper suitable for cross feed when the length of the horizontal side is shorter than that of the vertical side.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

DESCRIPTION OF THE PREFERRED EMBODIMENTS

Figure 1:
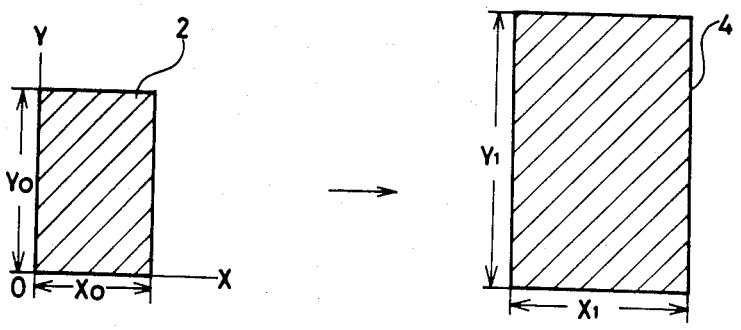
FIGS. 1(A) through 1(C) are illustrations for explaining magnification and reduction functions used for the present invention.
Figure 1:
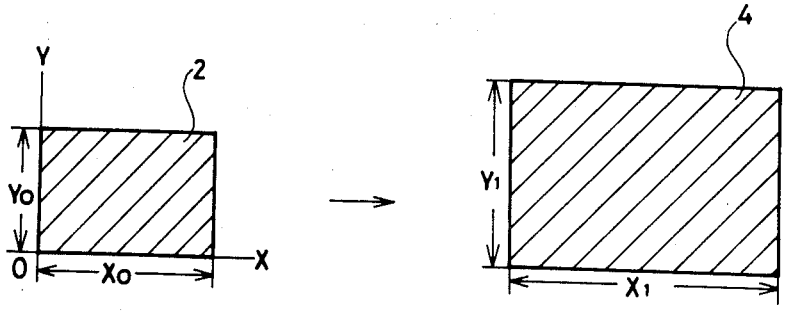
Figure 1:
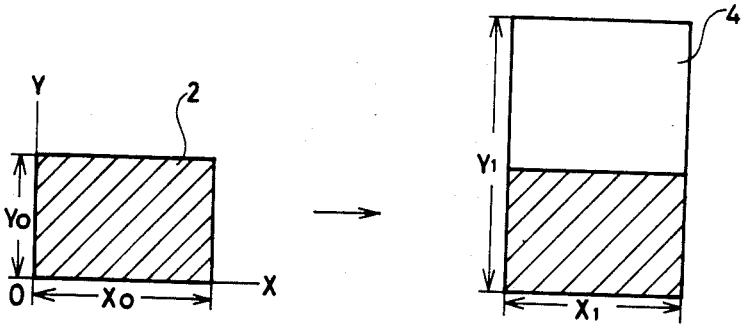

FIGS. 1(A) through 1(C) are illustrations for explaining the magnification or reduction functions with an electrophotographic copying machine according to the present invention.

With reference to FIG. 1(A), a document 2 is lengthwisely mounted on a document table. Its width "X0" along the horizontal axis is shorter than the length "Y0" along the vertical axis. To magnify or reduce the copy paper 2 widely in the full space of a copy paper, a copy paper 4 must be cross-fed, i.e., transported in such a condition that the longitudinal side "Y1" of the copy paper 4 is a front side to be faced, in parallel, with the paper inlet slit of the copying machine while the width side "X1" of the copy paper is normal to the paper inlet slit. This is called "cross feed or cross-fed" herein. An example of the magnification is that when the copy document 2 having a width "X0" of 120 mm and a length "Y0" of 180 mm is copied on A4 size copy paper which is cross-fed, the width "X1" is 210 mm and the length "Y1" is 297 mm. Magnification times "x" along the horizontal axis are $X1/X0=1.75$ while magnification times "y" along the vertical axis are $Y1/Y0=1/65$. The smaller magnification times of "y" of 1.65 are selected as the magnification times for the whole area, so as to copy the document as wide as possible in the copy paper.

To properly reduce the copy document widely in the full space of the copy paper, larger reduction times from "x" and "y" should be selected.

With reference to FIG. 1(B), a copy document 2 is mounted being in width (X0 longer than Y0) on the document table. In this case, to copy the document as wide as possible over the full space of the copy paper, the copy paper 4 should be transported as corresponding to the position of the copy document 2, i.e., in the condition that "X1" is longer than "Y1". The copy paper should be longitudinally-fed, i.e., transported in such a condition that the length "Y1" of the copy paper 4 becomes in front of the paper inlet slit of the copying machine while the width "X1" of the paper is normal to the paper inlet slit. This is called "longitudinal feed or longitudinally-fed" herein. It is assumed that the document 2 with a width "X0" of 180 mm and a length "Y0" of 120 mm is to be copied on A4R size copy paper in width (its side along the horizontal axis is longer than another side along the vertical axis). In such a case, "X1" is 297 mm and "Y1" is 210 mm. "x" defined with X1/X0 is 1.65 and "y" defined with Y1/Y0 is 1.75. Therefore, the smaller magnification times of 1.65 are selected as the whole times of the document, so as to provide a wide copy in the full space of the copy paper.

With reference to FIG. 1(C), the copy document 2 is mounted being in width (X0 longer than Y0). The copy paper 4 is cross-fed. In particular, the copy document 2 with "X0" of 180 mm and "Y0" of 120 mm is to be copied on A4 size copy paper which is cross-fed with having "X1" of 210 mm and "Y1" of 297 mm. The magnification times "x" along the horizontal axis are defined X1/X0=1.17 while the magnification times "y" along the vertical axis are defined Y1/Y0=2.48. The smaller magnification times of 1.17 are selected for the whole are of the copy paper so that the document image can be copied only in the lower half while the upper half remains blank.

In the cases of FIGS. 1(B) and 1(C), the document 2 in width is commonly used. An exact copying operation depends upon the selection of the suitable copy paper. Merely relied upon the judgement by the operator, conventionally, the case of FIG. 1(C) may erroneously happen rather than the correct case of FIG. 1(B). The current copy paper cassette must be replaced in the case of FIG. 1(C).

According to the present invention, the length "X0" along the horizontal axis and the length "Y0" along the vertical axis of the copy document 2 are measured so that suitable types of copy paper can be displayed which should receive either cross feed (X1 shorter than Y1) or longitudinal feed (X1 longer than Y1).

Figure 2:
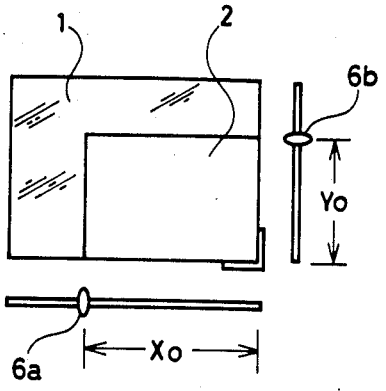
FIGS. 2(A) and 2(B) are a plan view.
FIG. 2(C) is a side view measurement means for measuring the length and the width of a copy document used for an electrophotographic copying machine according to the present invention.
Figure 2:
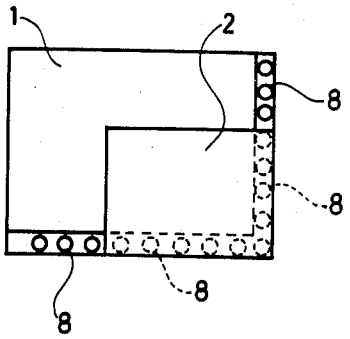
Figure 2:
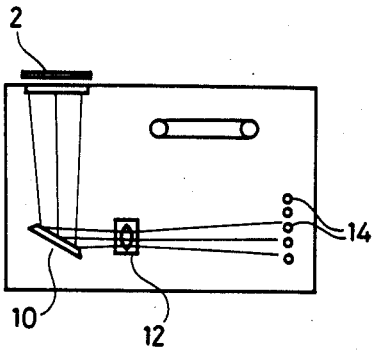

FIGS. 2(A) through 2(C) show measurement means for measuring the lengths "X0" and "Y0" of the copy document 2.

FIG. 2(A) shows measurement lever means for measuring the lengths "X0" and "Y0". The copy document 2 is disposed on the document table 1. A par of levers *6a* and *6b* are slidably provided, respectively, adjacent to the horizontal axis "X" and the vertical axis "Y". The pair of levers *6a* and *6b* can measure the legths "X0" and "Y0".

FIG. 2(B) shows sensor means for measuring the lengths "X0" and "Y0". It comprises a plurality of sensors 8 each composed of light emitting diodes (LEDs) dispersed, respectively, along the horizontal axis and the vertical axis. When the copy document 2 is mounted on the document table, some sonsors 8 are hidden by the document 2, so that depending on the positions of the hidden sensors 8, the lengths "X0" and "Y0" of the document 2 can be measured with the processing of the signals from the hidden sensors 8.

FIG. 2(C) shows an optical sensor means for measuring the lengths "X0" and "Y0". Light reflected by the copy document 2 can be incident upon an optical sensor 14 through a mirror 10 and a lens 12, so that according to the scale of the document 2, some optical sensors 14 are switched ON. Owing to the processing of the signals from the switched-ON optical sensors 14, the lengths "X0" and "Y0" can be measured.

Otherwise, the data of the lengths "X0" and "Y0" can be directly and manually inputted with operating some key switches. Further it may possible that the size of the copy document 2 such as A4 or B5 or the else can be manually inputted.

Figure 3:
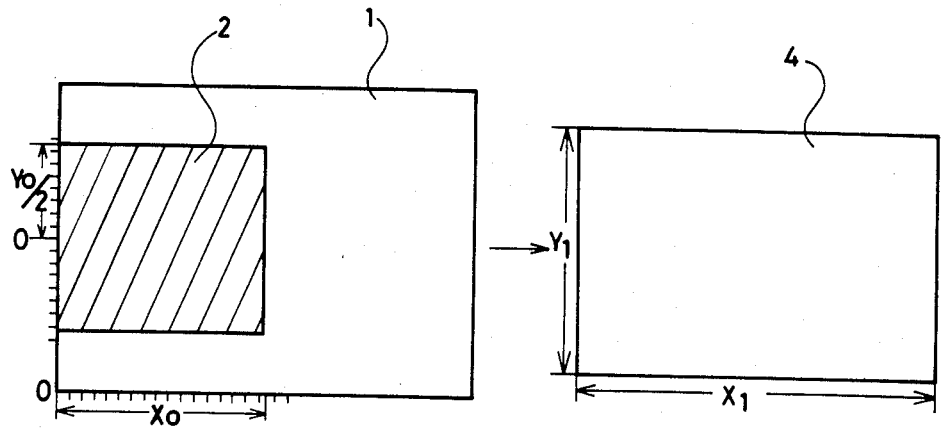
FIGS. 3(A) and 3(B) are illustrations for explaining the other magnification and reduction functions used for another electrophotographic copying machine of an automatic magnification/reduction-controllable type according to the present invention.
Figure 3:
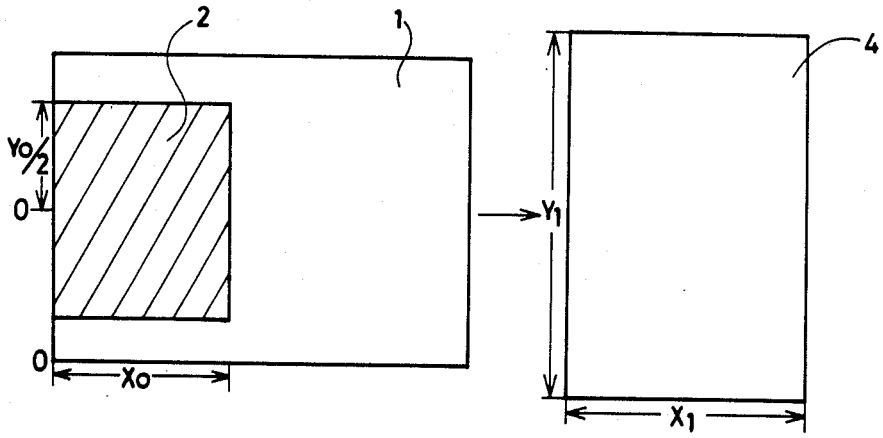

FIGS. 3(A) and 3(B) are illustrations for explaining another way to measure the lengths "X0" and "Y0". The examples of FIGS. 1(A) through 1(C) relate to the copying machine to measure the lengths "X0" and "Y0" in which the copy document 2 shoud be cornered in the document table. The examples of FIGS. 3(A) and 3(B) relate to the case in which the copy document should be centered in the document table.

With reference to FIGS. 3(A) and 3(B), the center of the vertical side of the copy document 2 is positioned at the center as the original point in the vertical side of the document table 1, so that the length of the vertical side of the document is Y0/2. The total length of the document in the vertical direction should be calculated by doubling the length of "Y0/2". In FIG. 3(A), a document 2 in width (X0 longer than Y0) is mounted on the table 1, so that a copy paper in width (X1 longer than Y1) is selected as being longitudinally-fed. In FIG. 3(B), a document 2 in depth (X0 shorter than Y0) is mounted on the table, a copy paper 4 in depth X1 shorter than Y1) is selected as being cross-fed.

The types of copy paper suitable for longitudinal feed are A4R, B5R, A3, and B4. The types of copy paper suitable for cross feed are A4, B5, A5, and B6. Depending on the type of copying machine, B4 and A3 paper can be cross-fed. That is, depending on the type of copying machine, the types of longitudinal feed paper and cross feed paper are defined. Therefore, a type of copy paper in depth (X1 shorter than Y1) should be selected for a document in depth (X0 shorter than Y0), and a type of copy paper in width (X1 longer than Y1) should be selected for a document in width (X0 longer than Y0). Throughout the present specification, the former copy paper in depth is defined as cross feed paper and the latter copy paper in width is defined as longitudinal feed paper.

Figure 6:
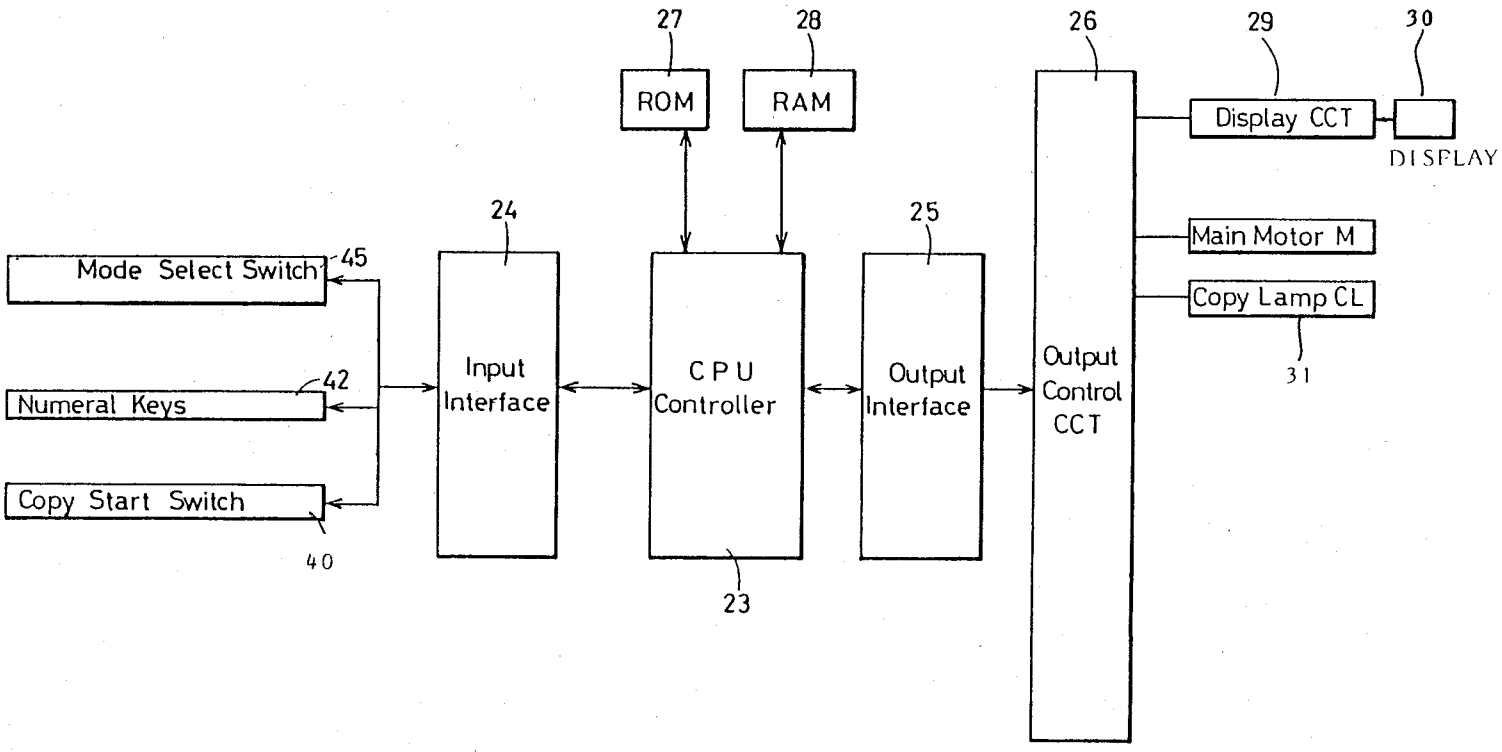
FIG. 6 is a block diagram of the copying machine according to the present invention.

FIG. 6 is a block diagram of the copying machine of the present invention.

The circuit of the copying machine comprises an input interface, a central processing unit (CPU) controller 23, an output interface 25, an output control circuit 26, a read only memory (ROM) 27, a random access memory (RAM) 28, a display circuit 29, a diaplay 30, a main motor M, a copy lamp (CL) 31, a copy start switch 40, numeral keys 42, and a mode select switch 45.

The CPU controller 23 is operated to dominate the operation of the copying machine. The input interface 24 is operated to communicate the CPU controller 23 with the copy start switch 40, the numeral keys 42, and the mode select switch 45. The ROM 27 stores the control program executing the copy equal mode and the automatic magnification/reduction mode. The RAM is provided for storing the necessary information to execute the program. The mode select switch 45 is operated to select either the copy equal mode or the automatic magnification mode or the automatic reduction mode. The numeral keys 42 are operated to select a suitable type of copy paper by the operator according to the present invention and to input the number of copies to be prepared. The copy start switch 40 is operated to start the copy operation. The display 30 enables the display information of the possible types and the finally selected type of copy paper according to the present invention, the number of the copy papers to be prepared, and the remaining number of the copies. The display 30 comprises a liquid crystal display or a plurality of light emitting diodes (LEDs). The display circuit 29 is provided for enabling the display in the display 30. The copy lamp (CL) 31 is operated to show that a set of copy operation is now possible. The output control circuit 26 is responsive to the CPU controller 23 through the output interface for controlling the display circuit 29, the main motor M, and the copy ready lamp 31. The main motor M is provided for rotating a photoreceptor and other elements.

Figure 4:
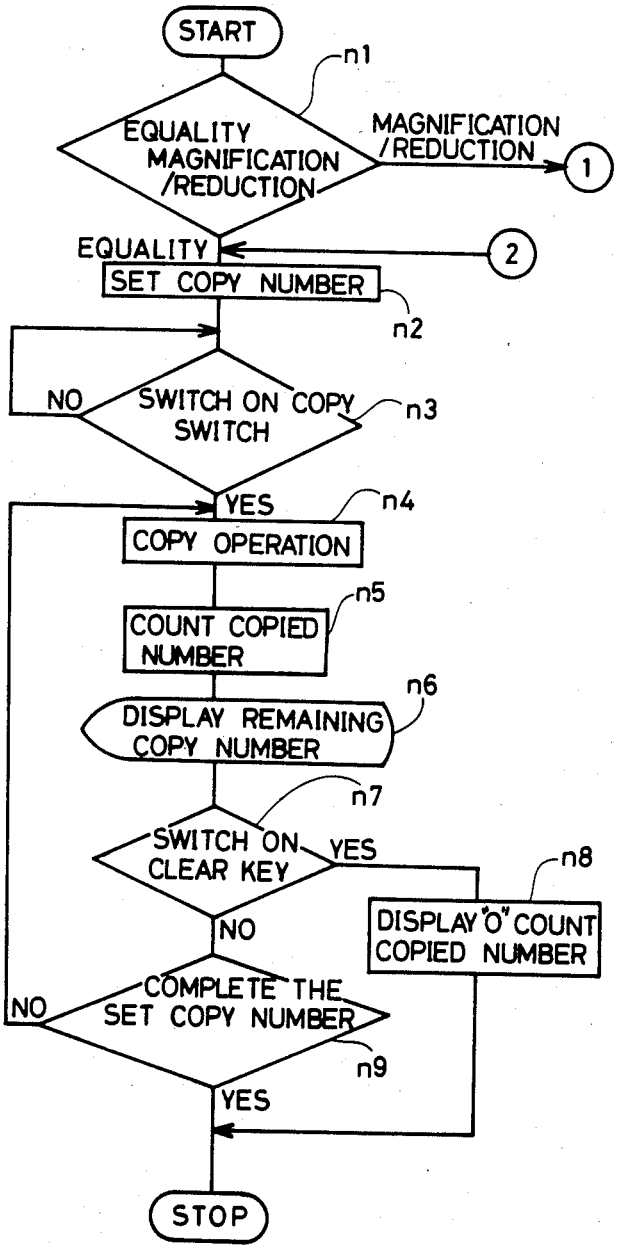
FIGS. 4 and 5 are a flow chart of the operation of the copying machine of the present invention.
Figure 5:
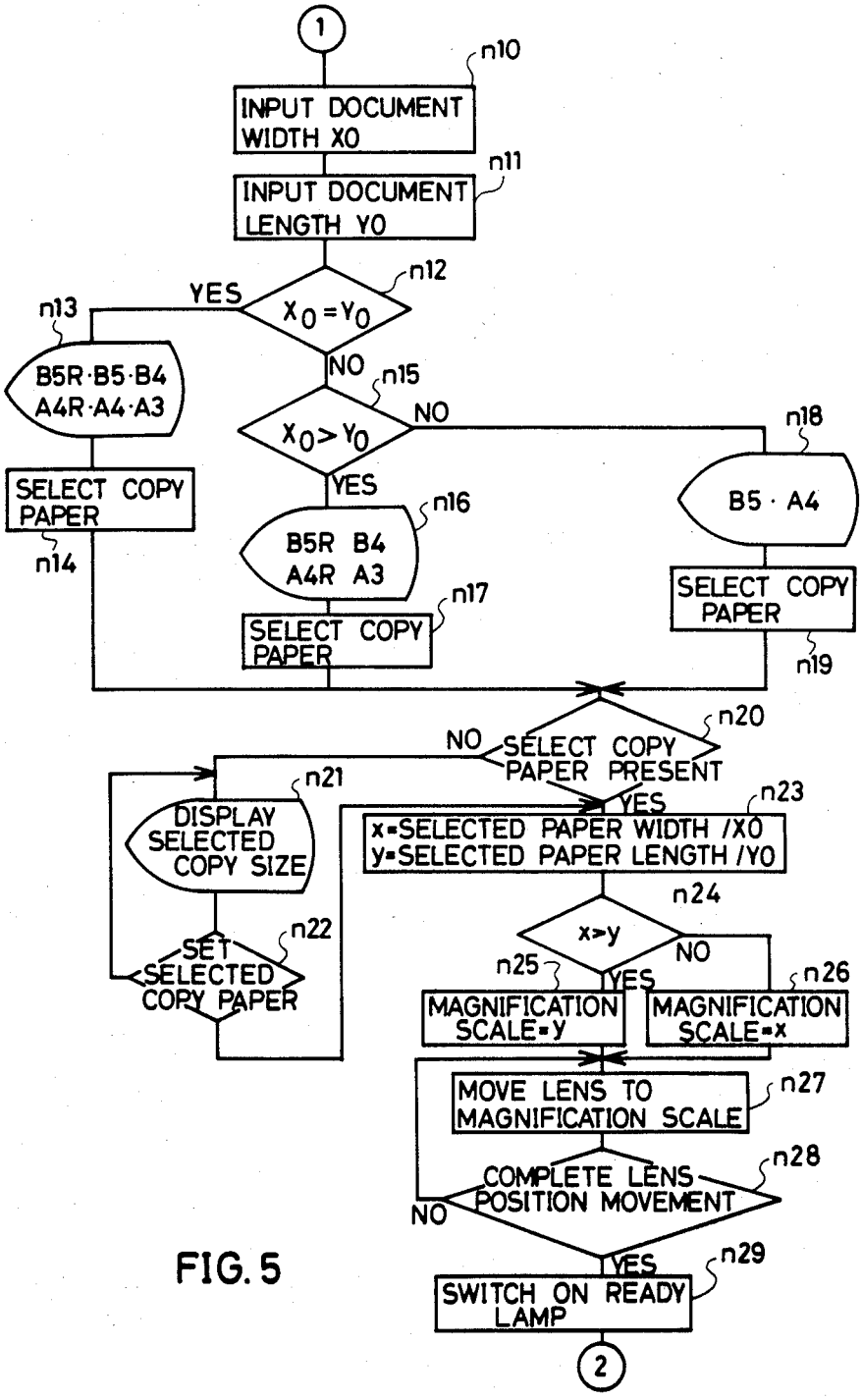

FIG. 4 is a flow chart of the general operation of the copying machine of the automatic magnification/reduction-controllable type. FIG. 5 is a flow chart of the function of the copying machine according to the present invention.

Step n1: It is detected whether the copy magnification/reduction mode or the copy equal mode is selected by the mode select switch 45.

Step n10: When the copy magnification/reduction mode is selected, step n10 is selected. In steps n10 and n11, two lengths of "X0" and "Y0" are measured by the measurement means and inputted.

Step n12: This step is executed to compare "X0" and "Y0".

Step n13: It is displayed in the display 30 that all the types of copy paper can be used concerning both longitudinal feed paper and cross feed paper.

Step n14: The operator can select a specific type of paper from all the types of paper displayed.

Steps n15–n17: When a document in width (X0 longer than Y0) is selected, some types of paper which should receive longitudinal feed are displayed in the display 30, so that the operator can select a desired type of paper from them.

Step n18: When a document in depth (X0 shorter than Y0) is used, some types of paper which should receive cross feed are displayed in the display 30 in step n18.

Step n19: The operator can select one type of paper form those displayed.

Step n20: When a specific type of copy paper is selected, it is detected in step n20 whether or not the copy paper cannot be supplied to the copying machine because either a copy paper cassette storing the type of paper is not coupled to the copying machine or the cassette presently coupled to the copying machine is empty.

Step n21: The selected type of copy paper is displayed in the display 30.

Step n22: The operator can couple a suitable paper cassette to the copying machine or supply some sheets of paper into the coupled cassette.

Step n23: After setting the copy paper, magnification/reduction times "x" along the horizontal axis and other magnification/reduction times "y" along the vertical axis are calculated. "x" is defined as X1/X0 in which "X1" is the length of the horizontal axis of the selected copy paper and "X0" is the length of the copy document along the horizontal axis. "y" is defined as Y1/Y0 in which "Y1" is the length of the selected paper along the vertical axis and "Y0" is the length of the document along the vertical axis.

Step n24: The magnification/reduction times "x" are compared with "y".

Steps n25 and n26: The smaller magnification times or the larger reduction times are selected as the whole magnification/reduction times so as to properly copy as wide or compact as possible. When "x" equal "y", either of "x" and "y" can be adopted.

Step n27: The position of the lens can be moved so as to provide the selected magnification/reduction times.

Step n28: It is detected whether or not the lens has been completely moved.

Step n29: The copy ready lamp 31 is switched ON to announce that the copy operation can be started.

Step n2: The number of copies to be prepared is set with the numeral keys 42.

Step n3: The copy start switch 40 is switched ON.

Step n4: The copy operation is carried out with the CPU controller 23.

Step n5: The number of the copies is counted down each time the copy operation is carried out.

Step n6: The remaining number of the copies is displayed in the display 30.

Step n7: It is detected whether a clear key in the numeral keys 42 is actuated during the copy operation to stop the further copy operation.

Step n8: "0" count is displayed in the display 30 as the remaining number of copies. Then, the further copy operation is stopped.

Step n9: If the clear key is not actuated, the copy oepartion is continually conducted to complete the set number of the copies. After the number is completed, the copy operation is stopped.

If step n1 is executed to detect that the copy equal mode is selected, step n2 is then selected. Steps n3 through n9 are executed to complete the set number of the copies.

In the above description, in steps n16 and n18, the types of copy paper for the longitudinal feed and other types of paper for the cross feed are displayed, respectively, It may be possible that the operator can freely select a type of paper without being restricted to the displayed types in these steps. For example, although the type of paper for the longitudinal feed is displayed for the copy document in width, the type of paper for cross feed can be selected to conduct the copy operation as shown in FIG. 1(C).

While only certain embodiments of the present invention have been described, it will be apparent to those skilled in the art that various changes and modifications may be made therein without departing from the sprit and scope of the present invention as claimed.

What is claimed is:

1. An electrophotographic copying machine of an automatic magnification/reduction-controllable type comprising:

measurement means for measuring the lengths of a horizontal side and a vertical side of a copy document;

comparison means responsive to said measurement means for comparing the length of the horizontal side with that of the vertical side; and display means responsive to said comparison means for displaying either a first type of copy paper suitable for longitudinal feed when the length of the horizontal side is longer than that of the vertical side or a second type of copy paper when the length of the horizontal side is shorter than that of the vertical side.

2. The machine of claim 1, further comprising detection means for detecting the lengths of the horizontal side and the vertical side of a sheet of copy paper to be used.

3. The machine of claim 2, wherein said comparison means is adopted to calculate a first ratio of the length of the horizontal side of the copy paper to that of the copy document and a second ratio of the length of the vertical side of the copy paper to that of the copy document.

4. The machine of claim 3, wherein said comparison means selects a smaller ratio from the two ratios as the whole ratio when the copy document is to be magnified and a larger ratio from the two ratios as the whole ratio when the copy document is to be reduced.

* * * * *